United States Patent [19]

Durling

[11] 3,950,932

[45] Apr. 20, 1976

[54] CABLED STUFFER BOX CRIMPED YARN AND METHOD OF PRODUCING THE SAME

[75] Inventor: William Woodbridge Durling, Annapolis, Md.

[73] Assignee: Concorde Fibers Inc., Columbia, Md.

[22] Filed: Dec. 30, 1974

[21] Appl. No.: 537,616

[52] U.S. Cl. ..... 57/140 R; 57/160

[51] Int. Cl.[2] ..... D02G 3/02; D02G 3/28

[58] Field of Search ..... 57/140 BY, 144, 160, 57/140 R, 156, 153

[56] References Cited

UNITED STATES PATENTS

| | | | |
|---|---|---|---|
| 2,134,022 | 10/1938 | Bell | 57/140 BY |
| 2,145,346 | 1/1939 | Dreyfus | 57/140 BY |
| 2,199,428 | 5/1940 | Finlayson et al. | 57/140 BY |
| 3,460,336 | 8/1969 | Collingwood et al. | 57/140 BY |

*Primary Examiner*—Donald E. Watkins
*Attorney, Agent, or Firm*—Nolte and Nolte

[57] ABSTRACT

A multi-colored, cabled, stuffer box crimped yarn containing filaments of respectively at least two non-contrasting colors and a contrasting color, the filaments of the at least two non-contrasting colors imparting a heather appearance to the yarn and the filaments of the contrasting color imparting color accents to the yarn, is produced by cabling together at least three stuffer box crimped multifilament ends, each of the three ends containing filaments of at least two non-contrasting colors and one of the three ends containing filaments of the contrasting color in a discrete grouping and in a proportion greater than the proportion in the same end of filaments of any individual non-contrasting color and, prior to being twisted together with the other ends, containing a twist in the same sense as the twist to be imparted in the step of twisting together all the ends and, after being twisted together with the other ends, preferably containing a twist of a higher degree than the twist contained in the other ends.

9 Claims, 1 Drawing Figure

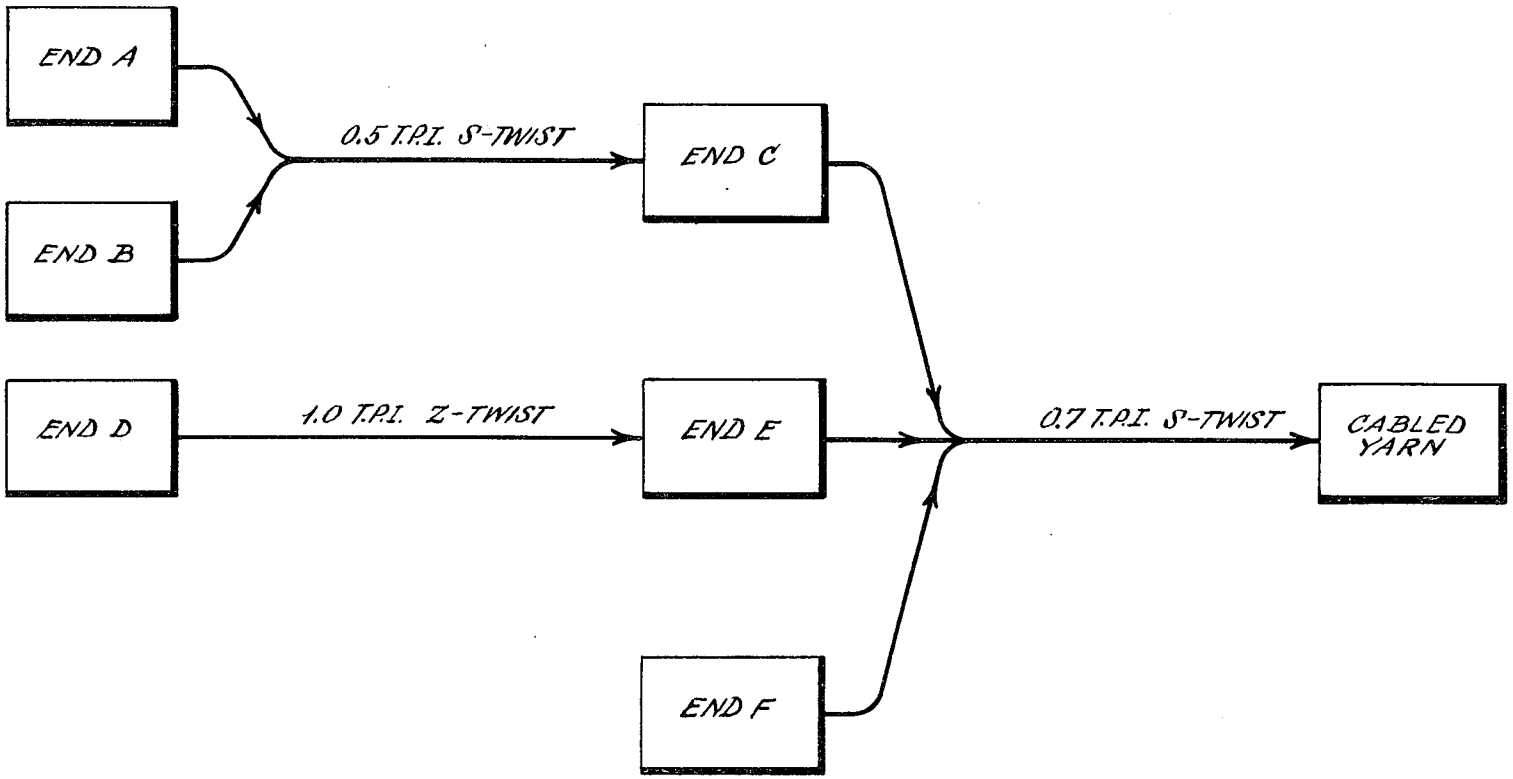
END A
END B
0.5 T.P.I. S-TWIST
END C
END D
1.0 T.P.I. Z-TWIST
END E
END F
0.7 T.P.I. S-TWIST
CABLED YARN

CABLED STUFFER BOX CRIMPED YARN AND METHOD OF PRODUCING THE SAME

This invention relates to a method of producing a multicolored, cabled, stuffer box crimped yarn having a heather appearance and color accents and to the resultant yarn.

Stuffer box crimping is a well known form of crimping in which a yarn in a permanently deformable state is folded upon itself whereby a crimp is imparted to the yarn. A stuffer box crimped yarn is visually distinguishable to one skilled in the art from other crimped yarns, such as gear crimped yarns, knit-deknit crimped yarns, jet crimped yarns, knife edge crimped yarns and false twist crimped yarns. To those skilled in the art, therefore, "stuffer box crimped" not only describes a process by which a yarn has been crimped but also the crimped yarn itself. While stuffer box crimped yarn has a desirable bulkiness which renders it particularly suitable for many uses, including the pile of carpeting, a disadvantage of stuffer box crimped yarn is the presence of "shiners," which are lengthwise segments of the crimped yarn in which the crimps in adjacent filaments are in registry causing such segments of the yarn to reflect more light than other segments of the yarn. For many textile products, including much carpeting, this is considered to be an undesirable characteristic. Another lengthwise non-uniformity occurring from time to time in many dyed or pigmented yarns are color variations. Also, in stuffer box crimped yarns, as in other crimped or texturized yarns, lengthwise non-uniformities in bulk or texture, apart from shiners, occur from time to time.

One object of the present invention is to eliminate or, more precisely, to conceal, such non-uniformities in stuffer box crimped yarn by a cabling technique related to that described in commonly assigned, co-pending application Ser. No. 443,059, filed Feb. 15, 1974.

Another object of the invention is to augment the concealment of the aforementioned non-uniformities while imparting to the yarn a color effect which is particularly appealing to the eye and makes up into such products as carpeting of particularly attractive appearance. To this end, there is provided a cabled yarn having a multi-colored appearance giving a heather effect as well as accents of a contrasting color. Hence, augmented concealment of yarn irregularities and a particularly interesting, attractive appearance are provided.

In particular, according to the present invention, there is provided a method of producing a multi-colored, cabled, stuffer box crimped yarn containing filaments of respectively at least two non-contrasting colors and a contrasting color, the filaments of the two non-contrasting colors imparting a heather appearance to the yarn and the filaments of the contrasting color being twisted in a discrete grouping and imparting color accents to the yarn. At least three stuffer box crimped multi-filament ends are cabled together, each of the three ends containing filaments of at least two non-contrasting colors and one of the three ends containing filaments of the contrasting color in a proportion greater than the proportion in the same end of filaments of any individual non-contrasting color and twisted in a discrete grouping.

The last mentioned end, prior to being twisted together with the other ends, contains a twist in the same sense as the twist to be imparted in the step of twisting together all the ends and, after being twisted together with the other ends, preferably contains a twist of a higher degree than the twist contained in the other ends.

The resultant yarn according to the invention projects a heather effect constituted of the non-contrasting colors and randomly spaced color accents constituted of the contrasting color. The term "contrast" is used herein in the senses in which it is described in the article entitled, "Color Vision," appearing at pages 319 to 322 of "Encyclopedia of Science and Technology," published by McGraw-Hill Book Co., copyrights 1960, 1966 and 1971. The term "non-contrasting" is employed as the antithesis of "contrasting" for lack of a better term.

Preferably, the total denier of all the ends which are to be cabled together is about 2,000 to about 20,000 and all of the filaments are within the denier range of about 3 to about 50 denier per filament.

The cabling in the present invention, consistent with the sense in which the term "cabling" is normally used, in general terms constitutes twisting together in a given sense at least three stuffer box crimped multifilament ends, at least one of which has previously been twisted in the opposite sense to a degree greater than the degree of twist applied in the step of twisting together all the ends. Particularly pronounced color accents are obtained when the filaments of the contrasting color are subjected as a discrete group to a twisting prior to the final twisting by which the cabling is consummated and both of said twistings are in the same sense. That keeps the contrasting color filaments in a compact figuration; otherwise, they would migrate and the color effect would not be accents, but rather, speckles, which speckles would even tend to get lost in the heather effect. The combined color accents and heather effect is best obtained when in the cabled yarn the end containing the filaments of the contrasting color is twisted to a degree greater than the degree of twist of any of the other ends.

By "degree of twist" is, of course, meant the number of turns of twist per unit length, normally expressed at t.p.i., i.e., turns per inch. Preferably, the amount of twist imparted to any end prior to the cabling is about 0.2 to about 10 turns per inch. Moreover, in the cabling step itself, the twisting of all the ends together by which the cabling is consummated, the degree of twist and the sense of the twist are so selected that the cabled yarn contains respective filaments having twists in opposite senses preferably in the range of about 0.2 to about 10 turns per inch.

The twisting operations may be conducted on any conventional twisters such as uptwisters and downtwisters.

The following examples, the first of which is to be considered in conjunction with the drawing, a schematic illustration of the process of the first example, are further illustrative of the invention.

EXAMPLE 1

A 36 filament/1350 denier stuffer box crimped end (End A in drawing) constituted equally of brown and yellow polypropylene filaments and a 36 filament/1350 denier stuffer box crimped end (End B in drawing) constituted of avocado polypropylene filaments are twisted together with 0.5 turn per inch of S-twist to form a twisted end (End C in drawing) of 2650 denier. A 72 filament/2650 denier stuffer box crimped end (End D in drawing) constituted of 18 gold, 18 mustard and 36 yellow polypropylene filaments is twisted with 1.0 turn per inch of Z-twist to form a twisted end of 2650 denier (End E in drawing). The two aforementioned twisted ends are twisted together with a third end to the extent of 0.7 turn per inch of S-twist to form a twisted (or, more specifically, cabled, since it contains S-twist and Z-twist) yarn of 7800 denier. The third end is initially untwisted, 72 filament/2650 denier stuffer box crimped polypropylene constituted of 18 gold, 18 mustard and 36 orange filaments. The yarn shows no shiners or other non-uniformaties along its length, is of a color appearance constituted of a heather effect comprised of the filaments of the colors other than the avocado and random avocado accents constituted of the avocado filaments and is tufted into a backing on a conventional tufting machine to form carpeting.

EXAMPLE 2

A 36 filament/1350 denier stuffer box crimped end constituted equally of yellow and champagne polypropylene filaments and a 36 filament/1350 denier stuffer box crimped end constituted of black polypropylene filaments are twisted together with 0.5 turn per inch of S-twist to form a twisted end of 2650 denier. A 72 filament/2650 denier stuffer box crimped end constituted equally of yellow, champagne, mustard and gold polypropylene filaments is twisted in the Z-direction to a degree of 1.0 turn per inch. The two aforementioned ends are twisted together with a third end to the extent of 0.7 turn per inch of S-twist to form a cabled yarn of 7800 denier. The third end is initially untwisted, 72 filament/2650 denier stuffer box crimped polypropylene constituted of 18 orange, 18 gold and 36 mustard filaments. The cabled yarn is heated at 248°F. for five minutes in order to augment the bulkiness or texture thereof; such heating step is commonly referred to as developing. The yarn shows no shiners or other non-uniformities along its length, is of a color appearance constituted of a heather effect comprised of filaments of the colors other than the black and random black accents constituted of the black filaments, and is tufted into a backing on a conventional tufting machine to form carpeting.

What is claimed is:

1. Method of producing a multicolored, cabled, stuffer box crimped yarn containing filaments of respectively at least two non-contrasting colors and a contrasting color, the filaments of the two non-contrasting colors imparting a heather appearance to the yarn and the filaments of the contrasting color imparting color accents to the yarn, comprising twisting together at least three stuffer box crimped multi-filament ends, each of said three ends containing filaments of at least two non-contrasting colors and one of said three ends containing filaments of the contrasting color in a discrete grouping and in a proportion greater than the proportion in the same end of filaments of any individual non-contrasting color, said one end, prior to said twisting together said at least three ends, containing a twist in the same sense as the twist in the step of twisting together said at least three ends.

2. Method according to claim 1, in which the total denier of all the ends which are to be cabled together is about 2000 to about 20,000.

3. Method according to claim 1, in which the amount of twist imparted to any end prior to the cabling is about 0.2 to about 10 turns per inch and the cabling is consummated by twisting all the ends together at a value in the range of about 0.2 to about 10 turns per inch and in a sense selected so that the cabled yarn contains respective filaments having twists in the range of about 0.2 to about 10 turns per inch in opposite senses.

4. Method according to claim 2, in which all of the filaments are within the denier range of about 3 to about 50 denier per filament.

5. A multicolored, cabled, stuffer box crimped yarn containing filaments of respectively at least two non-contrasting colors and a contrasting color, the filaments of the two non-contrasting colors imparting a heather appearance to the yarn and the filaments of the contrasting color imparting color accents to the yarn, the yarn being constituted of at least three stuffer box crimped multifilament ends cabled together, each of said three ends containing filaments of two non-contrasting colors and one of said three ends containing said filaments of the contrasting color in a proportion greater than the proportion in the same end of filaments of any individual non-contrasting color and being twisted in a discrete grouping.

6. Yarn according to claim 5, in which the total denier of all the ends which are to be cabled together is about 2,000 to about 20,000.

7. Yarn according to claim 5, in which the end containing the filaments of the contrasting color is twisted to a degree greater than the degree of twist of any of the other ends.

8. Yarn according to claim 5, containing filaments having twists in the range of about 0.2 to about 10 turns per inch in one sense and other filaments containing twists in the range of about 0.2 to about 10 turns per inch in the opposite sense.

9. Yarn according to claim 8, in which all of the filaments are within the denier range of about 3 to about 50 denier per filament.

* * * * *